US007880532B2

(12) United States Patent
Takaramoto et al.

(10) Patent No.: US 7,880,532 B2
(45) Date of Patent: Feb. 1, 2011

(54) REFERENCE VOLTAGE GENERATING CIRCUIT

(75) Inventors: Toshiharu Takaramoto, Kawasaki (JP); Kunihiko Gotoh, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/566,240

(22) Filed: Sep. 24, 2009

(65) Prior Publication Data

US 2010/0013540 A1 Jan. 21, 2010

Related U.S. Application Data

(63) Continuation of application No. PCT/JP2007/056854, filed on Mar. 29, 2007.

(51) Int. Cl.
*G05F 1/10* (2006.01)

(52) U.S. Cl. ..... 327/538

(58) Field of Classification Search ..... 327/530, 327/538–543

See application file for complete search history.

(56) References Cited

U.S. PATENT DOCUMENTS 5,239,256 A * 8/1993 Yoshida ..... 323/313
5,568,045 A * 10/1996 Koazechi ..... 323/314
5,861,771 A * 1/1999 Matsuda et al. ..... 327/540
5,955,873 A * 9/1999 Maccarrone et al. ..... 323/314
7,193,454 B1 * 3/2007 Marinca ..... 327/539
7,199,646 B1 * 4/2007 Zupcau et al. ..... 327/539
7,342,390 B2 * 3/2008 Tachibana et al. ..... 323/316
7,570,107 B2 * 8/2009 Kim et al. ..... 327/539
7,642,840 B2 * 1/2010 Kurata et al. ..... 327/538
2007/0052473 A1 * 3/2007 McLeod ..... 327/539

FOREIGN PATENT DOCUMENTS

JP 05-251954 9/1993
JP 08-185236 A 7/1996
JP 2000-323939 A 11/2000
JP 2004-192608 7/2004

* cited by examiner

*Primary Examiner*—Lincoln Donovan
*Assistant Examiner*—William Hernandez
(74) *Attorney, Agent, or Firm*—Arent Fox LLP

(57) ABSTRACT

There is provided a reference voltage generating circuit including: a first PN junction element (PN1) whose forward voltage is a first voltage V1; a second PN junction element (PN2) having a current density different from the first PN junction element and whose forward voltage is a second voltage V2 higher than the first voltage V1; and generating circuits (101 to 103) inputting the first voltage V1 and the second voltage V2 and generating a reference voltage expressed by A2×V2+A3×(A2×V2−A1×V1) in which A1, A2, and A3 are set to be coefficients, and in which A1 and A2 are different values.

20 Claims, 10 Drawing Sheets

REFERENCE VOLTAGE GENERATING CIRCUIT

CROSS REFERENCE TO THE RELATED APPLICATIONS

This application is a continuation application of International Application No. PCT/JP2007/056854, filed on Mar. 29, 2007, and designating the U.S., the entire contents of which are incorporated herein by reference.

FIELD

The present embodiment discussed herein relates to a reference voltage generating circuit.

BACKGROUND

FIG. 10 is a graph illustrating temperature dependence of current and voltage characteristics of a PN junction element. A logarithmic expression in which a horizontal axis thereof indicates a forward voltage Vbe [V] of the PN junction element and a vertical axis thereof indicates a forward current Ie [A] of the PN junction element is illustrated. The PN junction element is, for example, a bipolar transistor. The voltage Vbe is a voltage between a base and an emitter of the bipolar transistor, and the current Ie is an emitter current. Characteristics T1 to T6 indicate current and voltage characteristics in accordance with temperature. The characteristic T1 is when it is −40° C., the characteristic T2 is when it is 0° C., the characteristic T3 is when it is 25° C., the characteristic T4 is when it is 55° C., the characteristic T5 is when it is 85° C., and the characteristic T6 is when it is 125° C. In the case when the same current Ie flows, as temperature rises, the voltage Vbe lowers. A voltage V1 illustrated by a square mark indicates a voltage for allowing the current Ie, which is approximately $4\times10^{-9}$ [A], to flow, and as temperature rises, it lowers. A voltage V2 illustrated by a circle mark indicates a voltage for allowing the current Ie, which is approximately $5\times10^{-6}$ [A], to flow, and as temperature lowers, it rises. Here, the voltage V1 has high temperature dependence with respect to the voltage V2.

FIG. 11 is a graph illustrating a relation between a voltage of the PN junction element and temperature. A horizontal axis thereof indicates temperature and a vertical axis thereof indicates a voltage. The voltage V2, as illustrated in FIG. 10, lowers as temperature rises. On the other hand, a voltage V2−V1 rises as temperature rises.

A reference voltage generating circuit may generate a reference voltage that does not depend on temperature by using two PN junction elements having different current densities. A forward voltage of the first PN junction element is V1, and a forward voltage of the second PN junction element is V2. When the voltages V1 and V2 are in a relation of V1<V2, the reference voltage generating circuit generates a reference voltage Vref expressed by the reference voltage Vref=V2+α×(V2−V1). As illustrated in FIG. 11, if a coefficient α is selected appropriately, approximately 1.25 V as the reference voltage Vref that does not depend on temperature may be obtained.

In recent years, lowering voltage is required, and therefore, a reference voltage generating circuit operating at a voltage lower than 1.25 V is required. As one of low voltage techniques, Patent Document 1 that is described below exists. In Patent Document 1, an output voltage to be a reference voltage is set such that a voltage that is a times as large as a voltage V2−V1 being a voltage difference between a base and an emitter of bipolar transistors having different current densities and a voltage that is one-βth (β>1) of a voltage V2 between the base and the emitter of the bipolar transistor are added. That is, the reference voltage generating circuit generates the reference voltage Vref expressed by Vref=V2/β+α×(V2−V1).

However, the above reference voltage generating circuit has a problem in which a circuit scale is increased. For example, in an example of operation performed by a voltage illustrated in Patent Document 1, six operational amplifiers are used, resulting that there exist problems that an area occupied in a semiconductor chip and power consumption are increased.

Further, in Patent Document 2 that is described below, there is discussed a reference voltage generation circuit including: a first current generation circuit generating a current proportional to a difference between a first forward voltage of a PN junction and a second forward voltage of a PN junction having a different current density; a second current generation circuit generating a current to equalize a voltage proportional to the current obtained from the first current generation circuit and the first forward voltage; and a voltage addition circuit adding a voltage proportional to the current obtained from the second current generation circuit and the first forward voltage.

Patent Document 1: Japanese Laid-open Patent Publication No. Hei 05-251954

Patent Document 2: Japanese Laid-open Patent Publication No. 2004-192608

SUMMARY

According to an aspect of the embodiments, a reference voltage generating circuit includes a first PN junction element having a first voltage V1 as a forward voltage, a second PN junction element having a current density different from the first PN junction element and having a second voltage V2 higher than the first voltage as a forward voltage, and a generating circuit inputting the first voltage V1 and the second voltage V2, and generating a reference voltage expressed by A2×V2+A3×(A2×V2−A1×V1) in which A1, A2, and A3 are set to be coefficients and wherein A1 and A2 are different values.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

DESCRIPTION OF THE EMBODIMENTS

First Embodiment

Figure 1:
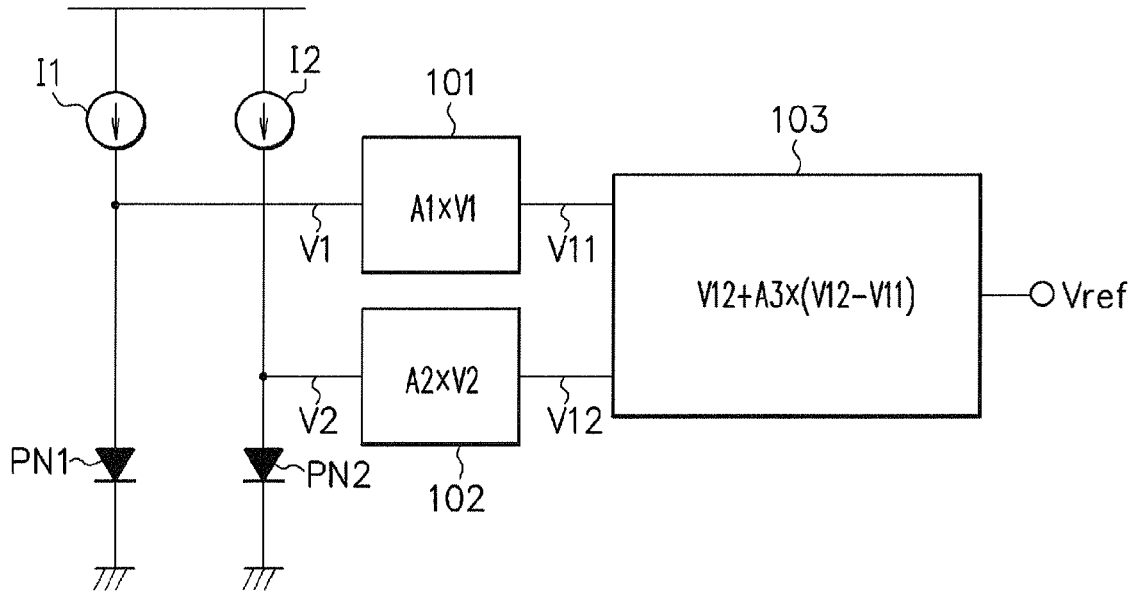
FIG. 1 is a circuit diagram illustrating a configuration example of a reference voltage generating circuit according to a first embodiment.

FIG. 1 is a circuit diagram illustrating a configuration example of a reference voltage generating circuit according to a first embodiment. A series coupling circuit composed of a first current source I1 and a first PN junction element PN1 is coupled between a power supply voltage terminal and a reference potential terminal (for example, a grounding terminal). A series coupling circuit composed of a second current source I2 and a second PN junction element PN2 is coupled between a power supply voltage terminal and a reference potential terminal. The PN junction elements PN1 and PN2 are, for example, diodes or transistors.

A forward voltage of the first PN junction element PN1 is a first voltage V1. The first current source I1 has a constant current flow to the first PN junction element PN1. When the first current source I1 has the current flow to the first PN junction element PN1, the first PN junction element PN1 generates the voltage V1.

A forward voltage of the second PN junction element PN2 is a second voltage V2. The second current source I2 has a constant current flow to the second PN junction element PN2. When the second current source I2 has the current flow to the second PN junction element PN2, the second PN junction element PN2 generates the voltage V2.

Figure 10:
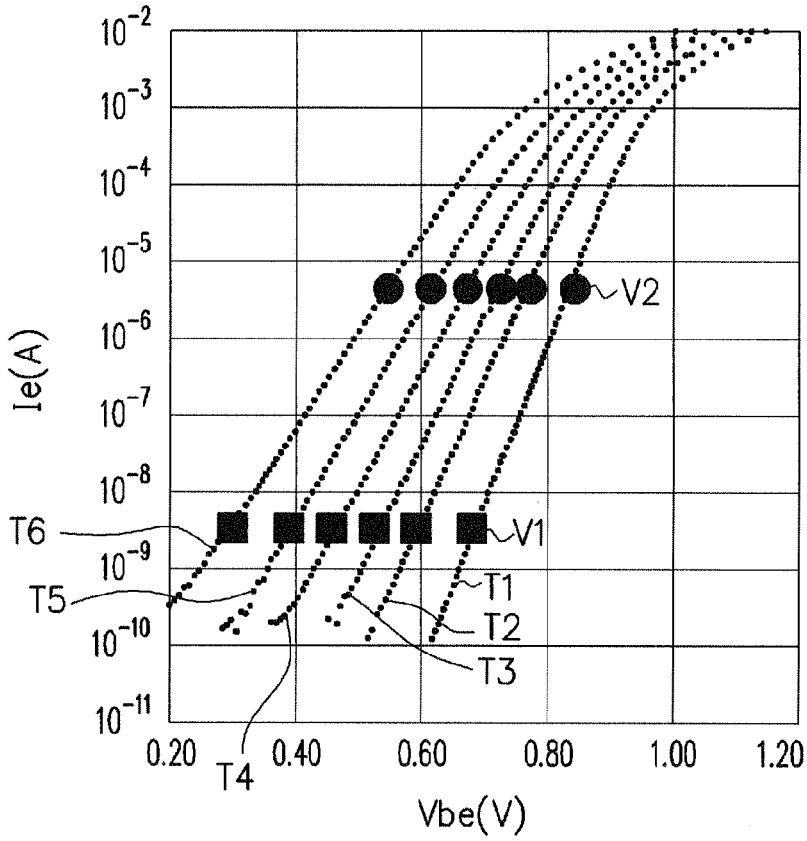
FIG. 10 is a graph illustrating temperature dependence of current and voltage characteristics of a PN junction element.

The PN junction elements PN1 and PN2 have current densities different from each other. In order to constitute the PN junction elements PN1 and PN2 having different current densities, two methods may be considered. The first method is to make PN junction areas of the first PN junction element PN1 and the second PN junction element PN2 different. The second method is to make a current value flowing from the first current source I1 and a current value flowing from the second current source I2 different. Either of the two methods is carried out thereby being able to constitute the PN junction elements PN1 and PN2 having current densities different from each other. Accordingly, the first voltage V1 that the first PN junction element PN1 generates and the second voltage V2 that the second PN junction element PN2 generates result in different voltages. Here, as illustrated in FIG. 10, the second voltage V2 that the second PN junction element PN2 generates is set to be higher than the first voltage V1 that the first PN junction element PN1 generates. That is, the current flowing to the second PN junction element PN2 is larger than the current flowing to the first PN junction element PN1.

A generating circuit 101 inputs the first voltage V1 generated in the first PN junction element PN1, and generates a voltage V11 expressed by the following expression in which the first voltage V1 is multiplied by a coefficient A1.

$$V11=A1\times V1$$

A generating circuit 102 inputs the second voltage V2 generated in the second PN junction element PN2, and generates a voltage V12 expressed by the following expression in which the second voltage V2 is multiplied by a coefficient A2. Here, the coefficients A1 and A2 are values different from each other.

$$V12=A2\times V2$$

A generating circuit 103 inputs the voltages V11 and V12, and generates a reference voltage Vref expressed by the following expression. Here, A3 is a coefficient.

$$\begin{aligned} Vref &= V12 + A3\times(V12 - V11) \\ &= A2\times V2 + A3\times(A2\times V2 - A1\times V1) \end{aligned}$$

Figure 11:
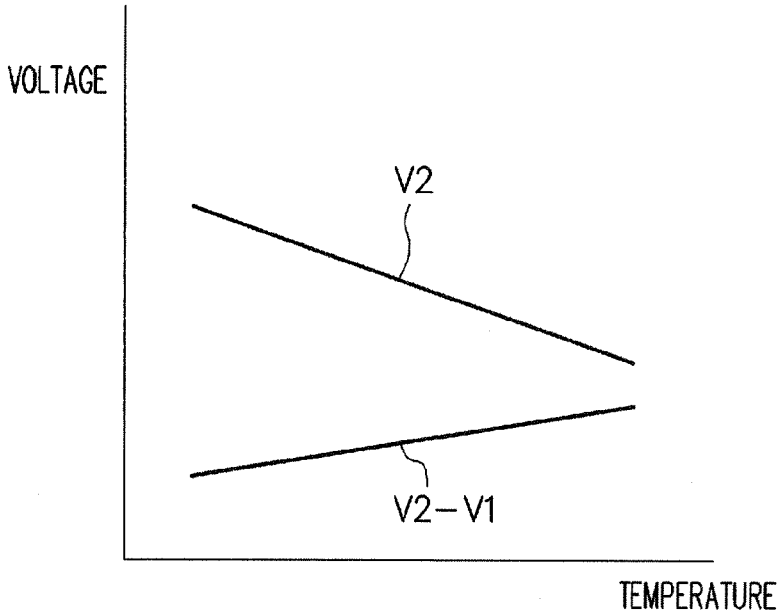
FIG. 11 is a graph illustrating a relation between a voltage of a PN junction element and temperature.

A1, A2, and A3 are coefficients including 1. The coefficients A1 and A2 are set to be different values, and thereby, as you can see from FIG. 11, the reference voltage Vref that does not depend on temperature may be obtained.

In Patent Document 1 that is described above, based on two voltages that are a forward voltage V1 of a PN junction element and a difference V2−V1 between a forward voltage of the other PN junction element whose current density is different and the forward voltage V1, a reference voltage Vref is operated. On the other hand, in the embodiment, the forward voltages V1 and V2 of the two PN junction elements PN1 and PN2 having different current densities are amplified (or attenuated) by the different coefficients A1 and A2 respectively beforehand, and then, the reference voltage Vref is operated, resulting that a circuit scale may be reduced.

At this time, in order to make practical low voltage operation in which a power supply voltage and the reference voltage Vref are equal to or less than 1.25 V, in most of the cases, the condition such that the coefficient A1 is larger than the coefficient A2 is required to be satisfied. When the coefficient A2 is 1, the circuit scale becomes the smallest, and the above case will be explained later as a second embodiment. An advantage with regard to the circuit scale becomes small, but the coefficient A2 is not limited to 1, and low voltage operation may be possible. Further, the case when the coefficient A1 is 1 will be explained later as a third embodiment. Further, the case when both of the coefficients A1 and A2 are smaller than 1 will be explained later as fourth and fifth embodiments. Further, the case when both of the coefficients A1 and A2 are larger than 1 will be explained later as a sixth embodiment. Further, the case when the coefficient A1 is larger than 1 and the coefficient A2 is smaller than 1 will be explained later as a seventh embodiment. Setting both of the coefficients A1 and A2 to be equal to or less than 1 brings a large advantage with regard to the point on which operation at a lower power supply voltage may be possible. An amplification in which an amplification factor being the coefficient is larger than 1 may be carried out in a non-inverting amplifier circuit, and an attenuation in which the amplification factor being the coefficient is smaller than 1 may be carried out by combining a voltage follower and a resistive voltage divider.

Second Embodiment

Figure 2:
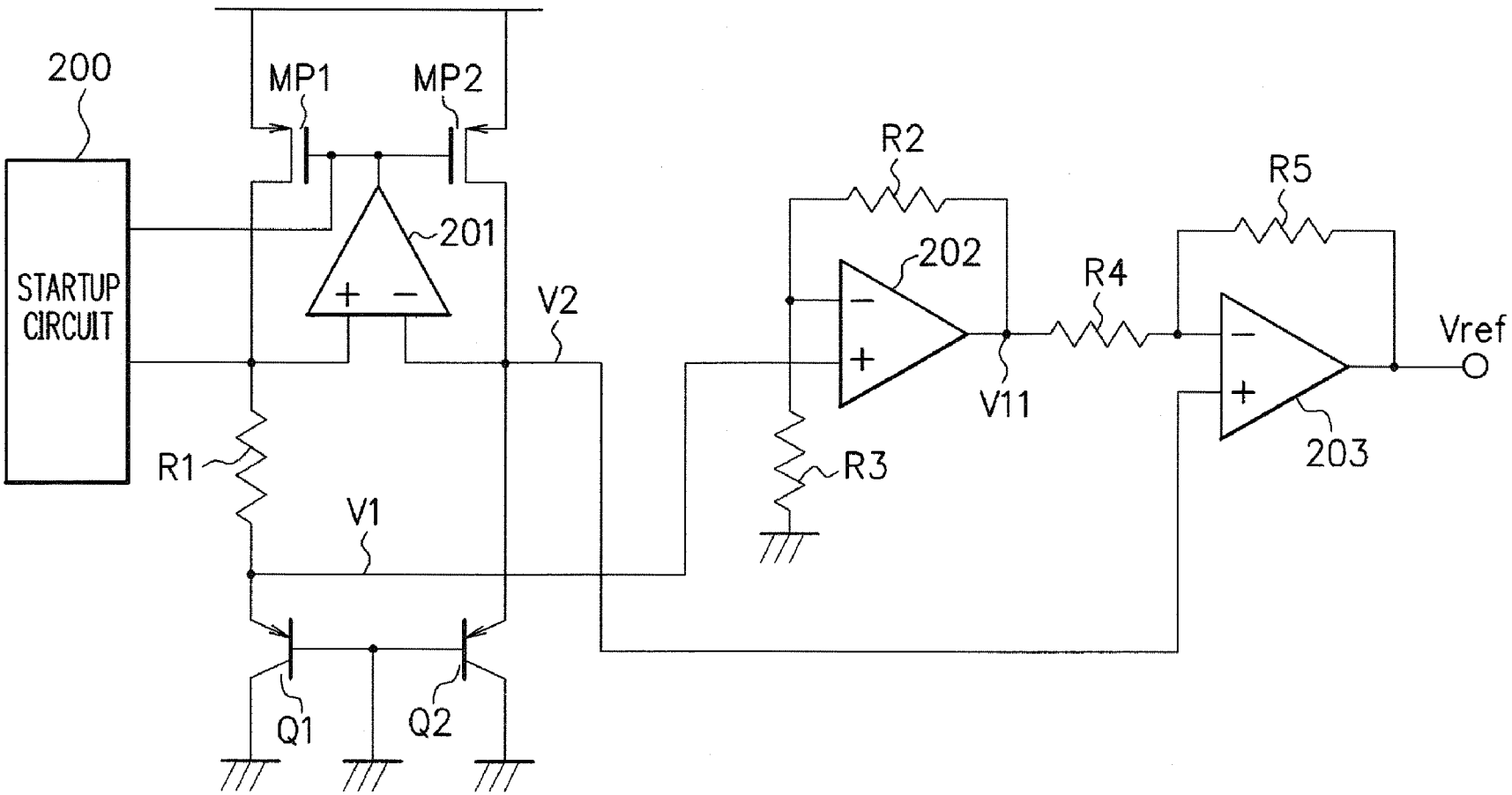
FIG. 2 is a circuit diagram illustrating a configuration example of a reference voltage generating circuit according to a second embodiment.

FIG. 2 is a circuit diagram illustrating a configuration example of a reference voltage generating circuit according to the second embodiment. A P-channel field effect transistor MP1 has a source thereof coupled to a power supply voltage terminal, and a gate thereof coupled to an output terminal of a differential amplifier circuit 201, and a drain thereof coupled to a non-inverting input terminal of the differential amplifier circuit 201. A PNP bipolar transistor Q1 has an emitter thereof coupled to the non-inverting input terminal of the differential amplifier circuit 201 via a resistance R1, and a base and a collector thereof coupled to reference potential terminals (for example, grounding terminals). The first voltage V1 is a voltage between the base and the emitter of the transistor Q1.

A P-channel field effect transistor MP2 has a source thereof coupled to a power supply voltage terminal, and a gate thereof coupled to the output terminal of the differential amplifier circuit 201, and a drain thereof coupled to an inverting input terminal of the differential amplifier circuit 201. A PNP bipolar transistor Q2 has an emitter thereof coupled to the inverting input terminal of the differential amplifier circuit 201, and a base and a collector thereof coupled to reference potential terminals. The second voltage V2 is a voltage between the base and the emitter of the transistor Q2.

The differential amplifier circuit 201 has the non-inverting input terminal thereof coupled between the transistor MP1 and the transistor Qt, and the inverting input terminal thereof coupled to the transistor MP2 and the transistor Q2, and the output terminal thereof coupled between the gates of the transistors MP1 and MP2. The resistance R1 is coupled between the transistor MP1 and the transistor Q1.

The differential amplifier circuit 201 is feedback-controlled so that voltages of the non-inverting input terminal and the inverting input terminal are made to be the same. The gates of the transistors MP1 and MP2 input the same voltage from the differential amplifier circuit 201, so that the transistors MP1 and MP2 have the same current flow.

The differential amplifier circuit 201 performs feedback on currents to flow to the transistors Q1 and Q2 from voltages determined by the forward voltages V1 and V2 of the transistors Q1 and Q2, so that there is a case that all input/output is stabilized even when it is at a high level. Therefore, it is preferable to provide a startup circuit 200. The startup circuit 200 is coupled to the non-inverting input terminal and the output terminal of the differential amplifier circuit 201, and controls the voltages of the non-inverting input terminal and the output terminal of the differential amplifier circuit 201. Note that the startup circuit 200 is not always needed.

The transistors Q1 and Q2 have the PN junction areas different from each other, and therefore, the current densities are different. The current flowing to the transistor Q2 is larger than the current flowing to the transistor Q1. As a result, the second voltage V2 is higher than the first voltage V1.

A differential amplifier circuit 202 has the first voltage V1 generated in the transistor Q1 input to a non-inverting input terminal thereof, and its own output terminal coupled to an inverting input terminal thereof via a resistance R2 and a reference potential terminal coupled to the inverting input terminal thereof via a resistance R3. The output voltage V11 from the differential amplifier circuit 202 is A1×V1. Here, the coefficient A1 is (R2+R3)/R3.

A differential amplifier circuit 203 has the second voltage V2 generated in the transistor Q2 input to a non-inverting input terminal thereof, and the output voltage V11 from the differential amplifier circuit 202 input to an inverting input terminal thereof via a resistance R4 and its own output voltage Vref input to the inverting input terminal thereof via a resistance R5 to output the reference voltage Vref.

The reference voltage generating circuit according to the embodiment generates the reference voltage Vref provided by the following expression in which, based on the second voltage V2, the difference V2−V11 made by subtracting the voltage V11 in which the first voltage V1 is amplified in a non-inverting manner (an amplification factor >1) by a ratio A1 obtained from the resistances R2 and R3 from the second voltage V2 is amplified in an inverting manner by a ratio A3 obtained from the resistances R4 and R5.

$$\begin{aligned} Vref &= V12 + A3 \times [V12 - V11] \\ &= A2 \times V2 + A3 \times [A2 \times V2 - A1 \times V1] \\ &= V2 + \left(\frac{R5}{R4}\right) \times \left[V2 - \left(\frac{R2+R3}{R3}\right) \times V1\right] \end{aligned} \quad \text{[Expression 1]}$$

Here, the coefficient A1 is (R2+R3)/R3, which is a value larger than 1. The coefficient A2 is 1. The coefficient A3 is R5/R4. The coefficients A1 and A2 are different values.

Hereinafter, a corresponding relation between the first embodiment and the second embodiment will be explained. The transistor MP1 corresponds to the first current source I1 in FIG. 1, and the transistor MP2 corresponds to the second current source I2 in FIG. 1. The transistor Q1 corresponds to the first PN junction element PN1 in FIG. 1, and the transistor Q2 corresponds to the second PN junction element PN2 in FIG. 1. The differential amplifier circuit 202 and the resistances R2 and R3 correspond to the generating circuit 101 in FIG. 1. The differential amplifier circuit 203 and the resistances R4 and R5 correspond to the generating circuit 103 in FIG. 1. Since the coefficient A2 is 1, the generating circuit 102 in FIG. 1 may be omitted.

The reference voltage generating circuit in the embodiment may reduce the number of differential amplifier circuits, so that the circuit scale may be reduced, and cost reduction and lower power consumption may be achieved. Further, it may be possible to make the power supply voltage and the reference voltage Vref low voltages that are equal to or less than 1.25 V.

Third Embodiment

Figure 3:
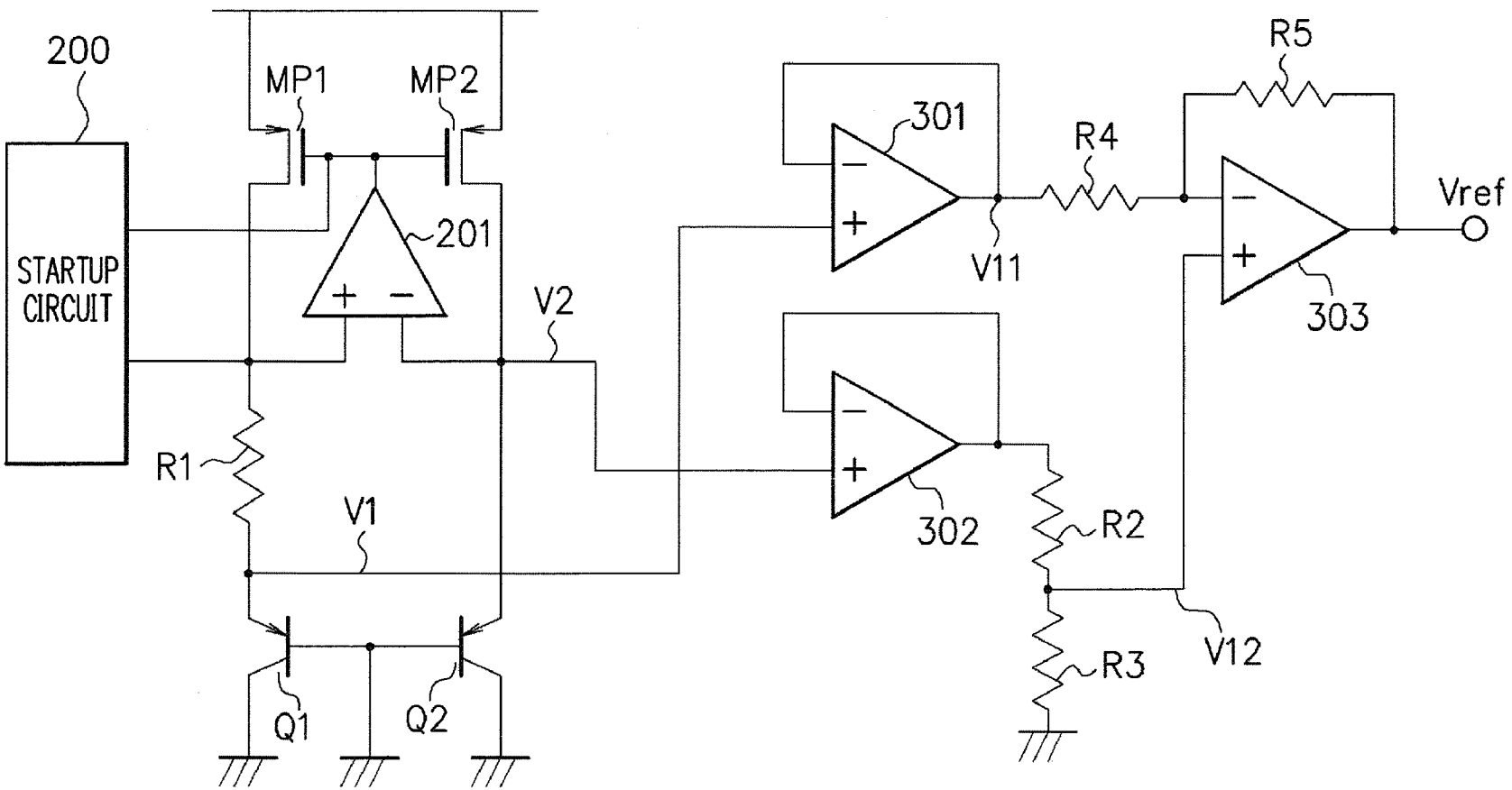
FIG. 3 is a circuit diagram illustrating a configuration example of a reference voltage generating circuit according to a third embodiment.

FIG. 3 is a circuit diagram illustrating a configuration example of a reference voltage generating circuit according to the third embodiment. The constitutions of the transistors MP1, MP2, Q1, and Q2, the differential amplifier circuit 201, the resistance R1, and the startup circuit 200 are the same as those of the second embodiment. Hereinafter, points on which the embodiment is different from the second embodiment will be explained.

A differential amplifier circuit 301 has the first voltage V1 generated in the transistor Q1 input to a non-inverting input terminal thereof, and its own output voltage V11 input to an inverting input terminal thereof. The output voltage V11 from the differential amplifier circuit 301 is A1×V1. Here, the coefficient A1 is 1, and therefore, the voltage V11 is the same as the voltage V1. The differential amplifier circuit 301 is a buffer for allowing a current to flow to the resistance R4, and it may be possible to prevent an input voltage from varying due to flow of the current.

A differential amplifier circuit 302 has the second voltage V2 generated in the transistor Q2 input to a non-inverting input terminal thereof, and its own output voltage input to an inverting input terminal thereof.

A differential amplifier circuit 303 has an output terminal of the differential amplifier circuit 302 coupled to a non-inverting input terminal thereof via the resistance R2 and a reference potential terminal coupled to the non-inverting input terminal thereof via the resistance R3, and the output voltage V11 from the differential amplifier circuit 301 input to an inverting input terminal thereof via the resistance R4 and its own output voltage Vref input to the inverting input terminal thereof via the resistance R5 to output the reference voltage Vref.

The voltage V12 to the non-inverting input terminal of the differential amplifier circuit 303 is A2×V2. Here, the coefficient A2 is R3/(R2+R3).

The reference voltage generating circuit according to the embodiment generates the reference voltage Vref provided by the following expression in which, based on the voltage V12 in which the second voltage V2 is attenuated (an amplification factor <1) by the ratio A2 obtained from the resistances R2 and R3, the difference V12−V1 made by subtracting the first voltage V1 from the voltage V12 is amplified in an inverting manner by the ratio A3 obtained from the resistances R4 and R5.

$$\begin{aligned} Vref &= V12 + A3 \times [V12 - V11] \\ &= A2 \times V2 + A3 \times [A2 \times V2 - A1 \times V1] \\ &= \left(\frac{R3}{R2+R3}\right) \times V2 + \left(\frac{R5}{R4}\right) \times \left[\left(\frac{R3}{R2+R3}\right) \times V2 - V1\right] \end{aligned} \quad \text{[Expression 2]}$$

Here, the coefficient A1 is 1. The coefficient A2 is R3/(R2+R3), which is a value smaller than 1. The coefficient A3 is R5/R4. The coefficients A1 and A2 are different values.

Hereinafter, a corresponding relation between the first embodiment and the third embodiment will be explained. The transistor MP1 corresponds to the first current source I1 in FIG. 1, and the transistor MP2 corresponds to the second current source I2 in FIG. 1. The transistor Q1 corresponds to the first PN junction element PN1 in FIG. 1, and the transistor Q2 corresponds to the second PN junction element PN2 in FIG. 1. The differential amplifier circuit 301 corresponds to the generating circuit 101 in FIG. 1. The differential amplifier circuit 302 and the resistances R2 and R3 correspond to the generating circuit 102 in FIG. 1. The differential amplifier circuit 303 and the resistances R4 and R5 correspond to the generating circuit 103 in FIG. 1.

The reference voltage generating circuit in the embodiment may reduce the number of differential amplifier circuits, so that the circuit scale may be reduced, and cost reduction and lower power consumption may be achieved. Further, it may be possible to make the power supply voltage and the reference voltage Vref low voltages that are equal to or less than 1.25 V.

Fourth Embodiment

Figure 4:
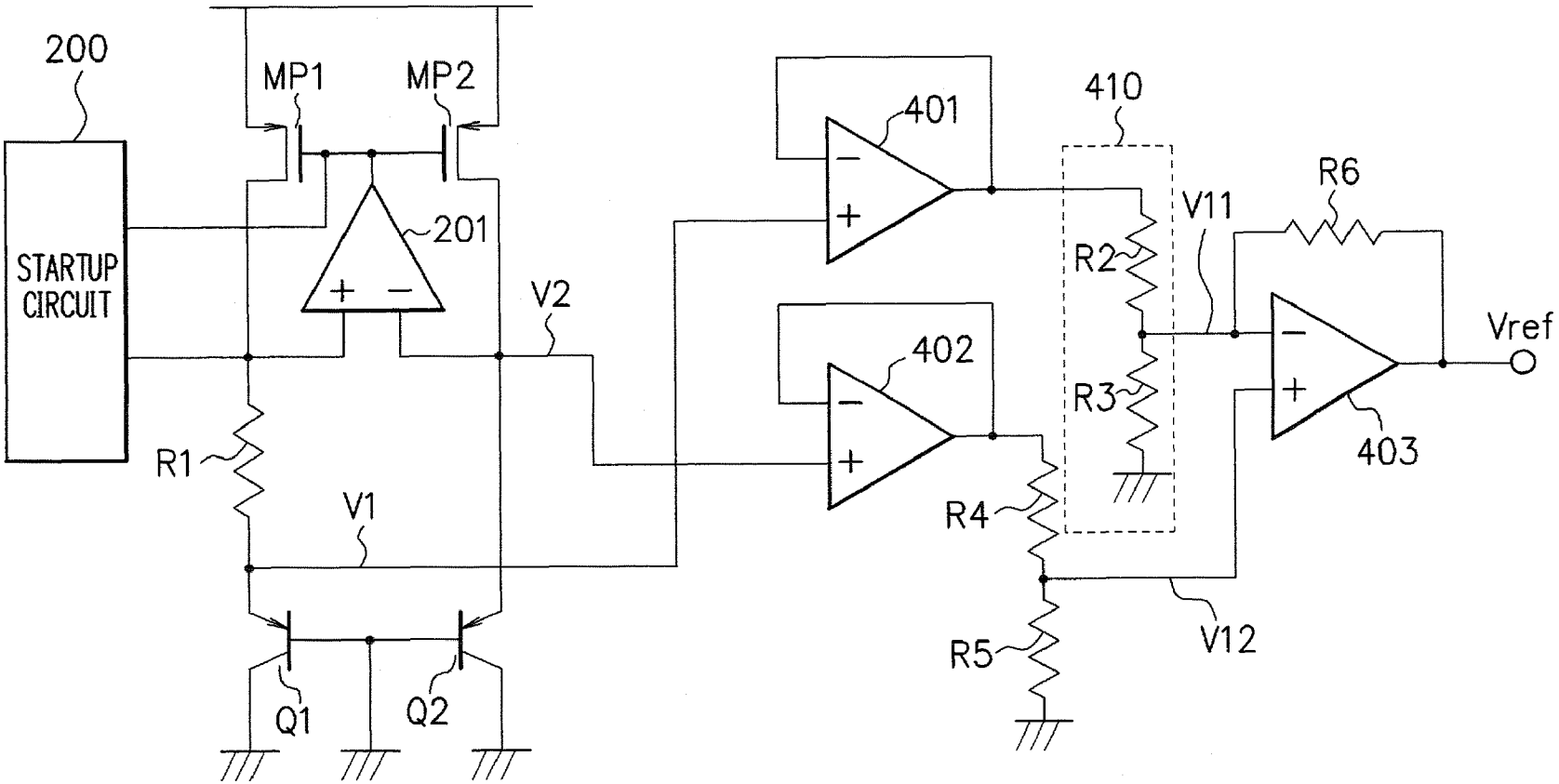
FIG. 4 is a circuit diagram illustrating a configuration example of a reference voltage generating circuit according to a fourth embodiment.

FIG. 4 is a circuit diagram illustrating a configuration example of a reference voltage generating circuit according to the fourth embodiment. The constitutions of the transistors MP1, MP2, Q1, and Q2, the differential amplifier circuit 201, the resistance R1, and the startup circuit 200 are the same as those of the second embodiment. Hereinafter, points on which the embodiment is different from the second embodiment will be explained.

A differential amplifier circuit 401 has the first voltage V1 generated in the transistor Q1 input to a non-inverting input terminal thereof, and its own output voltage input to an inverting input terminal thereof.

A differential amplifier circuit 402 has the second voltage V2 generated in the transistor Q2 input to a non-inverting input terminal thereof, and its own output voltage input to an inverting input terminal thereof.

A differential amplifier circuit 403 has an output terminal of the differential amplifier circuit 402 coupled to a non-inverting input terminal thereof via the resistance R4 and a reference potential terminal coupled to the non-inverting input terminal thereof via the resistance R5, and an output terminal of the differential amplifier circuit 401 coupled to an inverting input terminal thereof via the resistance R2 and a reference potential terminal coupled to the inverting input terminal thereof via the resistance R3 and its own output terminal coupled to the inverting input terminal thereof via a resistance R6 to output the reference voltage Vref.

The voltage V11 to the inverting input terminal of the differential amplifier circuit 403 is A1×V1. Here, the coefficient A1 is R3/(R2+R3). Further, the voltage V12 to the non-inverting input terminal of the differential amplifier circuit 403 is A2×V2. Here, the coefficient A2 is R5/(R4+R5).

The reference voltage generating circuit according to the embodiment generates the reference voltage Vref provided by the following expression in which, based on the voltage V12 in which the second voltage V2 is attenuated (an amplification factor <1) by the ratio A2 obtained from the resistances R4 and R5, the difference V12−V11 made by subtracting the voltage V11 in which the first voltage V1 is attenuated by the ratio A1 obtained from the resistances R2 and R3 from the voltage V12 is amplified in an inverting manner.

$$\begin{aligned} Vref &= V12 + A3 \times [V12 - V11] \\ &= A2 \times V2 + A3 \times [A2 \times V2 - A1 \times V1] \\ &= \left(\frac{R5}{R4+R5}\right) \times V2 + \left(\frac{R6}{R2 // R3}\right) \times \\ &\quad \left[\left(\frac{R5}{R4+R5}\right) \times V2 - \left(\frac{R3}{R2+R3}\right) \times V1\right] \end{aligned} \quad \text{[Expression 3]}$$

Here, R2//R3 represents R2×R3/(R2+R3). The coefficient A1 is R3/(R2+R3), which is a value smaller than 1. The coefficient A2 is R5/(R4+R5), which is a value smaller than 1. The coefficient A3 is R6/(R2//R3). The coefficients A1 and A2 are different values.

Hereinafter, a corresponding relation between the first embodiment and the fourth embodiment will be explained. The transistor MP1 corresponds to the first current source I1 in FIG. 1, and the transistor MP2 corresponds to the second current source I2 in FIG. 1. The transistor Q1 corresponds to the first PN junction element PN1 in FIG. 1, and the transistor Q2 corresponds to the second PN junction element PN2 in FIG. 1. The differential amplifier circuit 401 and the resistances R2 and R3 correspond to the generating circuit 101 in FIG. 1. The differential amplifier circuit 402 and the resistances R4 and R5 correspond to the generating circuit 102 in FIG. 1. The differential amplifier circuit 403 and the resistances R2, R3, and R6 correspond to the generating circuit 103 in FIG. 1.

The reference voltage generating circuit in the embodiment may reduce the number of differential amplifier circuits, so that the circuit scale may be reduced, and cost reduction and lower power consumption may be achieved. Further, it may be possible to make the power supply voltage and the reference voltage Vref low voltages that are equal to or less than 1.25 V.

Fifth Embodiment

Figure 5:
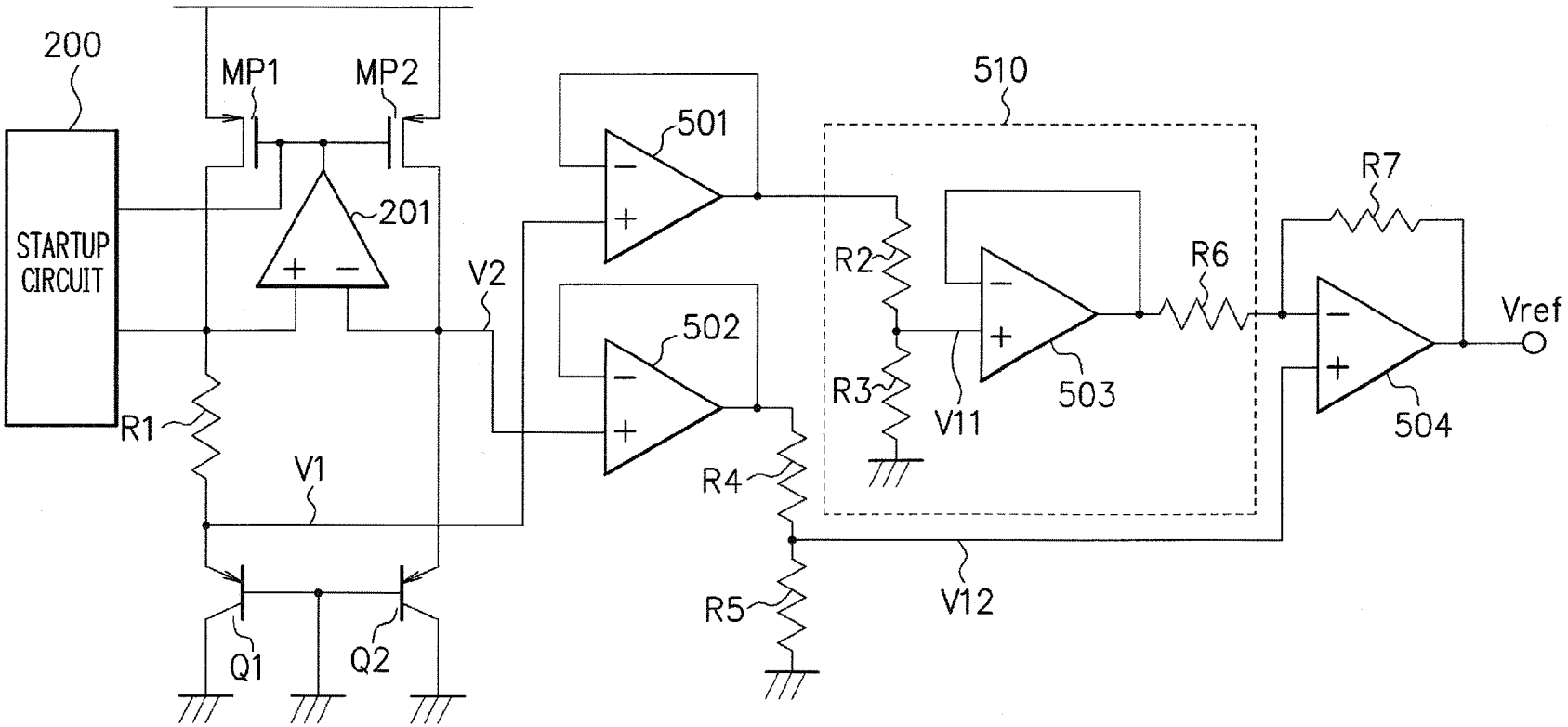
FIG. 5 is a circuit diagram illustrating a configuration example of a reference voltage generating circuit according to a fifth embodiment.

FIG. 5 is a circuit diagram illustrating a configuration example of a reference voltage generating circuit according to the fifth embodiment. The constitutions of the transistors MP1, MP2, Q1, and Q2, the differential amplifier circuit 201, the resistance R1, and the startup circuit 200 are the same as those of the second embodiment. Hereinafter, points on which the embodiment is different from the second embodiment will be explained.

A differential amplifier circuit 501 has the first voltage V1 generated in the transistor Q1 input to a non-inverting input terminal thereof, and its own output voltage input to an inverting input terminal thereof.

A differential amplifier circuit 502 has the second voltage V2 generated in the transistor Q2 input to a non-inverting input terminal thereof, and its own output voltage input to an inverting input terminal thereof.

A differential amplifier circuit 503 has an output terminal of the differential amplifier circuit 501 coupled to a non-inverting input terminal thereof via the resistance R2 and a reference potential terminal coupled to the non-inverting input terminal thereof via the resistance R3, and its own output voltage input to an inverting input terminal thereof.

A differential amplifier circuit 504 has an output terminal of the differential amplifier circuit 502 coupled to a non-inverting input terminal thereof via the resistance R4 and a reference potential terminal coupled to the non-inverting input terminal thereof via the resistance R5, and an output voltage from the differential amplifier circuit 503 input to an inverting input terminal thereof via the resistance R6 and its own output voltage Vref input to the inverting input terminal thereof via a resistance R7 to output the reference voltage Vref.

The voltage V11 to the non-inverting input terminal of the differential amplifier circuit 503 is A1×V1. Here, the coefficient A1 is R3/(R2+R3). Further, the voltage V12 to the non-inverting input terminal of the differential amplifier circuit 504 is A2×V2. Here, the coefficient A2 is R5/(R4+R5).

The reference voltage generating circuit according to the embodiment generates the reference voltage Vref provided by the following expression in which, based on the voltage V12 in which the second voltage V2 is attenuated (an amplification factor <1) by the ratio A2 obtained from the resistances R4 and R5, the difference V12−V11 made by subtracting the voltage V11 in which the first voltage V1 is attenuated by the ratio A1 obtained from the resistances R2 and R3 from the voltage V12 is amplified in an inverting manner.

$$\begin{aligned} Vref &= V12 + A3 \times [V12 - V11] \\ &= A2 \times V2 + A3 \times [A2 \times V2 - A1 \times V1] \\ &= \left(\frac{R5}{R4+R5}\right) \times V2 + \left(\frac{R7}{R6}\right) \times \\ &\quad \left[\left(\frac{R5}{R4+R5}\right) \times V2 - \left(\frac{R3}{R2+R3}\right) \times V1\right] \end{aligned} \quad \text{[Expression 4]}$$

Here, the coefficient A1 is R3/(R2+R3), which is a value smaller than 1. The coefficient A2 is R5/(R4+R5), which is a value smaller than 1. The coefficient A3 is R7/R6. The coefficients A1 and A2 are different values.

Hereinafter, a corresponding relation between the first embodiment and the fifth embodiment will be explained. The transistor MP1 corresponds to the first current source I1 in FIG. 1, and the transistor MP2 corresponds to the second current source I2 in FIG. 1. The transistor Q1 corresponds to the first PN junction element PN1 in FIG. 1, and the transistor Q2 corresponds to the second PN junction element PN2 in FIG. 1. The differential amplifier circuit 501 and the resistances R2 and R3 correspond to the generating circuit 101 in FIG. 1. The differential amplifier circuit 502 and the resistances R4 and R5 correspond to the generating circuit 102 in FIG. 1. The differential amplifier circuits 503 and 504 and the resistances R6 and R7 correspond to the generating circuit 103 in FIG. 1.

The reference voltage generating circuit in the embodiment may reduce the number of differential amplifier circuits, so that the circuit scale may be reduced, and cost reduction and lower power consumption may be achieved. Further, it may be possible to make the power supply voltage and the reference voltage Vref low voltages that are equal to or less than 1.25 V.

Figure 6:
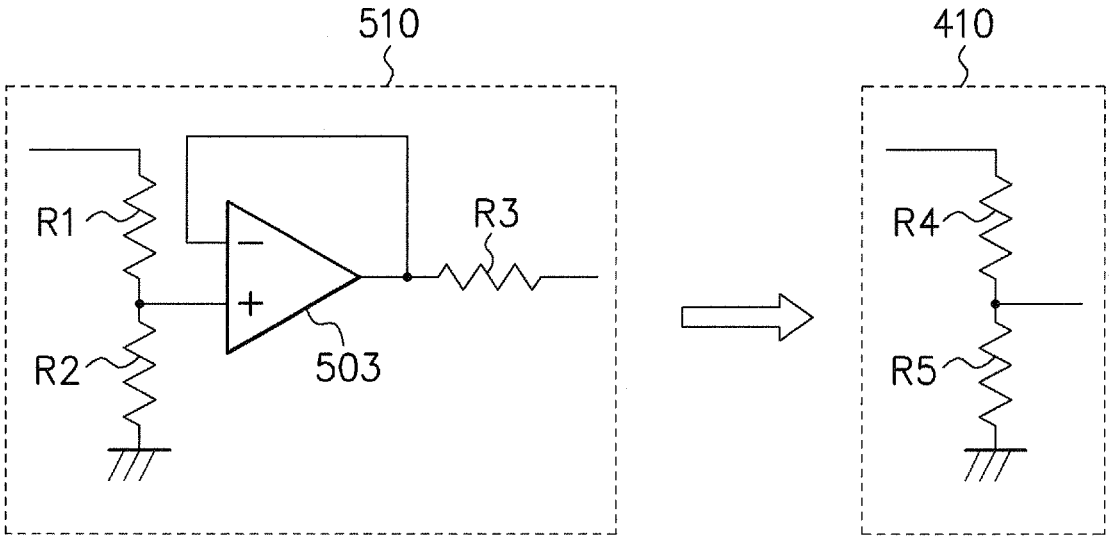
FIG. 6 is a circuit diagram for explaining a relation between the reference voltage generating circuits according to the fourth and fifth embodiments.

FIG. 6 is a circuit diagram for explaining a relation between the reference voltage generating circuits according to the fourth and fifth embodiments. The reference voltage generating circuit according to the fourth embodiment in FIG. 4 and the reference voltage generating circuit according to the fifth embodiment in FIG. 5 are equivalent circuits. A circuit 510 in FIG. 6 is such that the resistances R2, R3, and R6 in a circuit 510 in FIG. 5 are respectively replaced with the resistances R1, R2, and R3. A circuit 410 in FIG. 6 is such that the resistances R2 and R3 in a circuit 410 in FIG. 4 are respectively replaced with the resistances R4 and R5. The circuit 510 may be replaced with the circuit 410 equivalent to the circuit 510. In this case, relations expressed by the following expressions are established.

$$R5/(R4+R5)=R2/(R1+R2)$$

$$R4 \times R5/(R4+R5)=R3$$

The reference voltage generating circuit in FIG. 5 has the circuit 510 replaced with the circuit 410 thereby resulting in the reference voltage generating circuit in FIG. 4. The reference voltage generating circuits in FIG. 4 and FIG. 5 are equivalent circuits. The reference voltage generating circuit in FIG. 4 may reduce the circuit scale with respect to the reference voltage generating circuit in FIG. 5.

Sixth Embodiment

Figure 7:
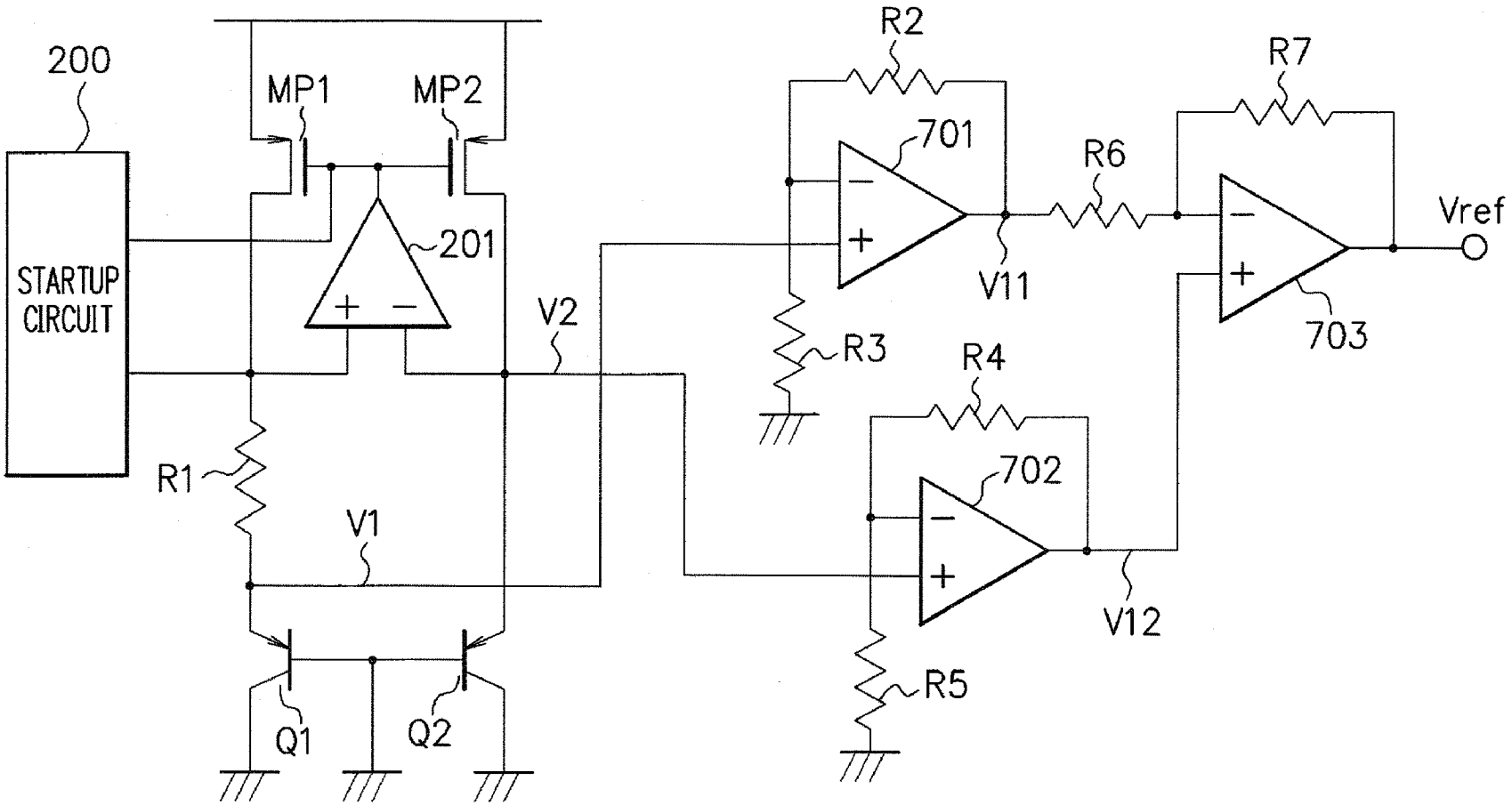
FIG. 7 is a circuit diagram illustrating a configuration example of a reference voltage generating circuit according to a sixth embodiment.

FIG. 7 is a circuit diagram illustrating a configuration example of a reference voltage generating circuit according to the sixth embodiment. The constitutions of the transistors MP1, MP2, Q1, and Q2, the differential amplifier circuit 201, the resistance R1, and the startup circuit 200 are the same as those of the second embodiment. Hereinafter, points on which the embodiment is different from the second embodiment will be explained.

A differential amplifier circuit 701 has the first voltage V1 generated in the transistor Q1 input to a non-inverting input terminal thereof, and its own output terminal coupled to an inverting input terminal thereof via the resistance R2 and a reference potential terminal coupled to the inverting input terminal thereof via the resistance R3.

A differential amplifier circuit 702 has the second voltage V2 generated in the transistor Q2 input to a non-inverting input terminal thereof, and its own output terminal coupled to an inverting input terminal thereof via the resistance R4 and a reference potential terminal coupled to the inverting input terminal thereof via the resistance R5.

A differential amplifier circuit 703 has the output voltage V12 from the differential amplifier circuit 702 input to a non-inverting input terminal thereof, and the output voltage V11 from the differential amplifier circuit 701 input to an inverting input terminal thereof via the resistance R6 and its own output voltage Vref input to the inverting input terminal thereof via the resistance R7 to output the reference voltage Vref.

The output voltage V11 from the differential amplifier circuit 701 is A1×V1. Here, the coefficient A1 is (R2+R3)/R3. Further, the output voltage V12 from the differential amplifier circuit 702 is A2×V2. Here, the coefficient A2 is (R4+R5)/R5.

The reference voltage generating circuit according to the embodiment generates the reference voltage Vref provided by the following expression in which, based on the voltage V12 in which the second voltage V2 is amplified in a non-inverting manner (an amplification factor >1) by the ratio A2 obtained from the resistances R4 and R5, the difference V12−V11 made by subtracting the voltage V11 in which the first voltage V1 is amplified in a non-inverting manner (an amplification factor >1) by the ratio A1 obtained from the resistances R2 and R3 from the voltage V12 is amplified in an inverting manner by the ratio A3 obtained from the resistances R6 and R7.

$$\begin{aligned} Vref &= V12 + A3 \times [V12 - V11] \\ &= A2 \times V2 + A3 \times [A2 \times V2 - A1 \times V1] \\ &= \left(\frac{R4+R5}{R5}\right) \times V2 + \left(\frac{R7}{R6}\right) \times \\ &\quad \left[\left(\frac{R4+R5}{R5}\right) \times V2 - \left(\frac{R2+R3}{R3}\right) \times V1\right] \end{aligned} \quad \text{[Expression 5]}$$

Here, the coefficient A1 is (R2+R3)/R3, which is a value larger than 1. The coefficient A2 is (R4+R5)/R5, which is a value larger than 1. The coefficient A3 is R7/R6. The coefficients A1 and A2 are different values.

Hereinafter, a corresponding relation between the first embodiment and the sixth embodiment will be explained. The transistor MP1 corresponds to the first current source I1 in FIG. 1, and the transistor MP2 corresponds to the second current source I2 in FIG. 1. The transistor Q1 corresponds to the first PN junction element PN1 in FIG. 1, and the transistor Q2 corresponds to the second PN junction element PN2 in FIG. 1. The differential amplifier circuit 701 and the resistances R2 and R3 correspond to the generating circuit 101 in FIG. 1. The differential amplifier circuit 702 and the resistances R4 and R5 correspond to the generating circuit 102 in FIG. 1. The differential amplifier circuit 703 and the resistances R6 and R7 correspond to the generating circuit 103 in FIG. 1.

The reference voltage generating circuit in the embodiment may reduce the number of differential amplifier circuits, so that the circuit scale may be reduced, and cost reduction and lower power consumption may be achieved. Further, it may be possible to make the power supply voltage and the reference voltage Vref low voltages that are equal to or less than 1.25 V.

Seventh Embodiment

Figure 8:
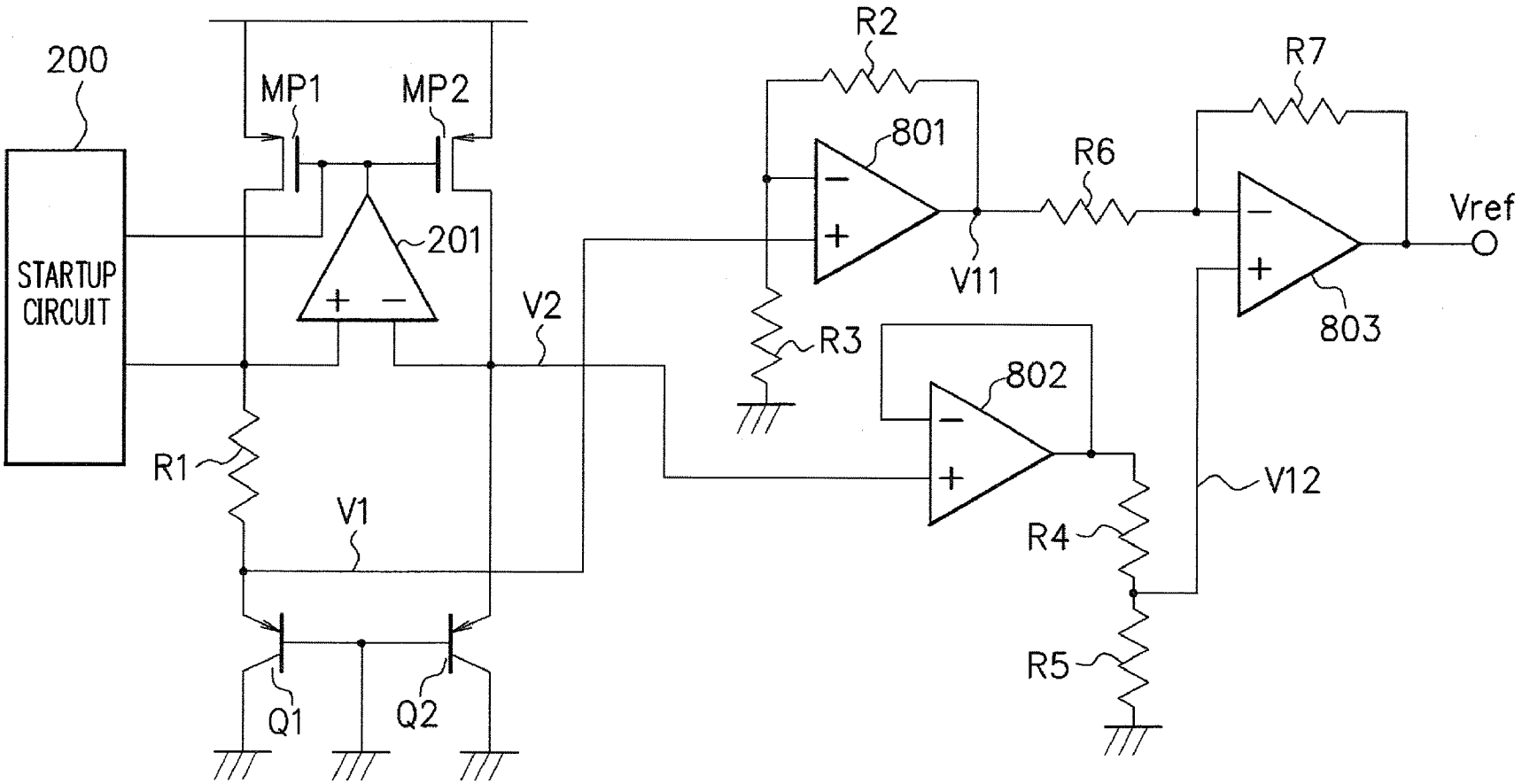
FIG. 8 is a circuit diagram illustrating a configuration example of a reference voltage generating circuit according to a seventh embodiment.

FIG. 8 is a circuit diagram illustrating a configuration example of a reference voltage generating circuit according to the seventh embodiment. The constitutions of the transistors MP1, MP2, Q1, and Q2, the differential amplifier circuit 201, the resistance R1, and the startup circuit 200 are the same as those of the second embodiment. Hereinafter, points on which the embodiment is different from the second embodiment will be explained.

A differential amplifier circuit 801 has the first voltage V1 generated in the transistor Q1 input to a non-inverting input terminal thereof, and its own output terminal coupled to an inverting input terminal thereof via the resistance R2 and a reference potential terminal coupled to the inverting input terminal thereof via the resistance R3.

A differential amplifier circuit 802 has the second voltage V2 generated in the transistor Q2 input to a non-inverting input terminal thereof, and its own output voltage input to an inverting input terminal thereof.

A differential amplifier circuit 803 has an output terminal of the differential amplifier circuit 802 coupled to a non-inverting input terminal thereof via the resistance R4 and a reference potential terminal coupled to the non-inverting input terminal thereof via the resistance R5, and an output voltage from the differential amplifier circuit 801 input to an inverting input terminal thereof via the resistance R6 and its own output voltage Vref input to the inverting input terminal thereof via the resistance R7 to output the reference voltage Vref.

The output voltage V11 from the differential amplifier circuit 801 is A1×V1. Here, the coefficient A1 is (R2+R3)/R3. Further, the voltage V12 to the non-inverting input terminal of the differential amplifier circuit 803 is A2×V2. Here, the coefficient A2 is R5/(R4+R5).

The reference voltage generating circuit according to the embodiment generates the reference voltage Vref provided by the following expression in which, based on the voltage V12 in which the second voltage V2 is attenuated (an amplification factor <1) by the ratio A2 obtained from the resistances R4 and R5, the difference V12−V11 made by subtracting the voltage V11 in which the first voltage V1 is amplified in a non-inverting manner (an amplification factor >1) by the ratio A1 obtained from the resistances R2 and R3 from the voltage V12 is amplified in an inverting manner by the ratio A3 obtained from the resistances R6 and R7.

$$\begin{aligned} Vref &= V12 + A3 \times [V12 - V11] \\ &= A2 \times V2 + A3 \times [A3 \times V2 - A1 \times V1] \\ &= \left(\frac{R5}{R4+R5}\right) \times V2 + \left(\frac{R7}{R6}\right) \times \\ &\quad \left[\left(\frac{R5}{R4+R5}\right) \times V2 - \left(\frac{R2+R3}{R3}\right) \times V1\right] \end{aligned} \quad \text{[Expression 6]}$$

Here, the coefficient A1 is (R2+R3)/R3, which is a value larger than 1. The coefficient A2 is R5/(R4+R5), which is a value smaller than 1. The coefficient A3 is R7/R6. The coefficients A1 and A2 are different values.

Hereinafter, a corresponding relation between the first embodiment and the seventh embodiment will be explained. The transistor MP1 corresponds to the first current source I1 in FIG. 1, and the transistor MP2 corresponds to the second current source I2 in FIG. 1. The transistor Q1 corresponds to the first PN junction element PN1 in FIG. 1, and the transistor Q2 corresponds to the second PN junction element PN2 in FIG. 1. The differential amplifier circuit 801 and the resistances R2 and R3 correspond to the generating circuit 101 in FIG. 1. The differential amplifier circuit 802 and the resistances R4 and R5 correspond to the generating circuit 102 in FIG. 1. The differential amplifier circuit 803 and the resistances R6 and R7 correspond to the generating circuit 103 in FIG. 1.

The reference voltage generating circuit in the embodiment may reduce the number of differential amplifier circuits, so that the circuit scale may be reduced, and cost reduction and lower power consumption may be achieved. Further, it may be possible to make the power supply voltage and the reference voltage Vref low voltages that are equal to or less than 1.25 V.

Eighth Embodiment

Figure 9:
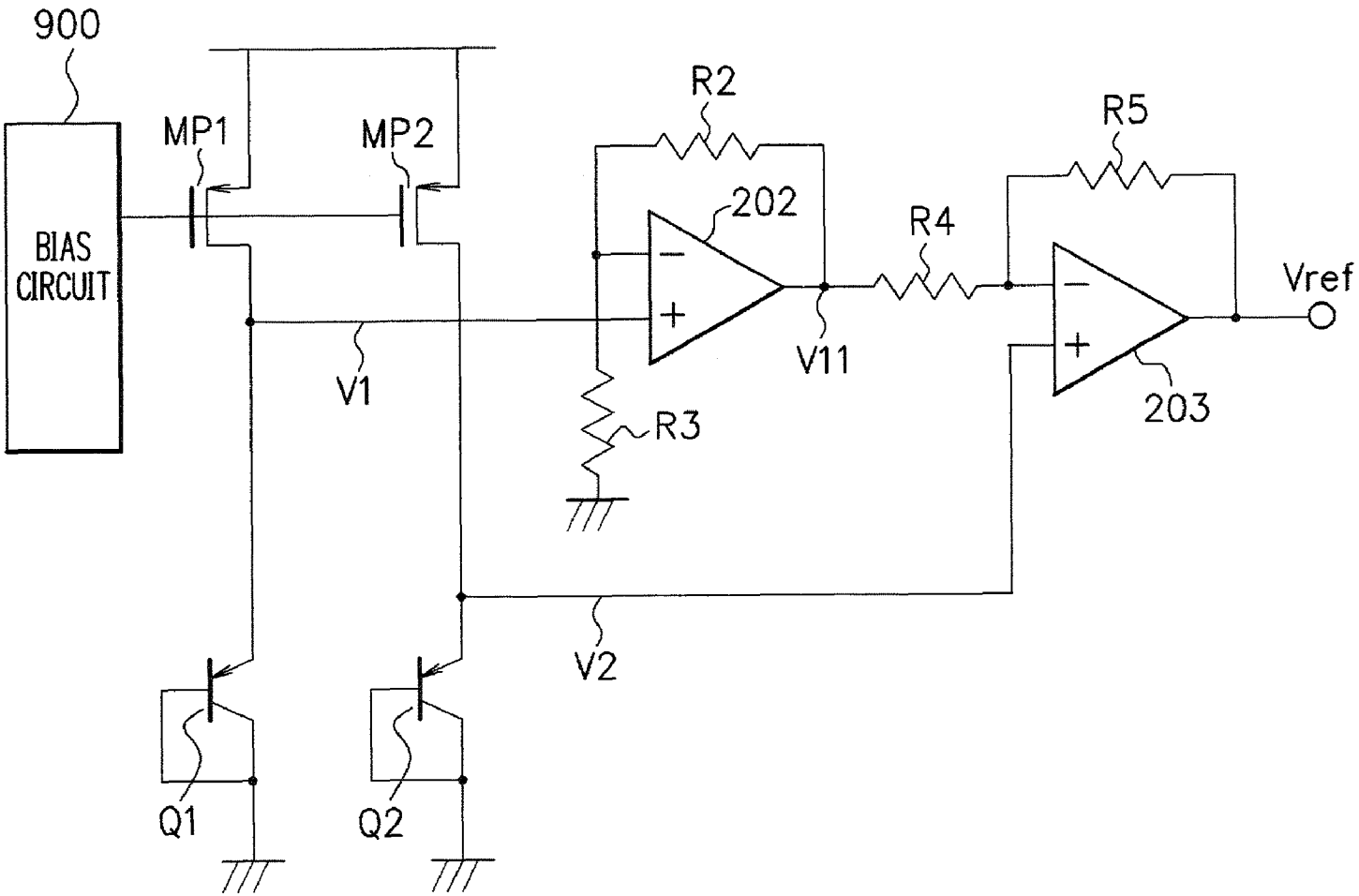
FIG. 9 is a circuit diagram illustrating a configuration example of a reference voltage generating circuit according to an eighth embodiment.

FIG. 9 is a circuit diagram illustrating a configuration example of a reference voltage generating circuit according to the eighth embodiment. The embodiment in FIG. 9 is such that, with respect to the second embodiment in FIG. 2, the startup circuit 200, the differential amplifier circuit 201, and the resistance R1 are eliminated, and a bias circuit 900 is added. Hereinafter, points on which the embodiment is different from the second embodiment will be explained.

The transistor MP1 has a source thereof coupled to a power supply voltage terminal, and a gate thereof coupled to the bias circuit 900, and a drain thereof coupled to an emitter of the transistor Q1. The transistor Q1 has a base and a collector thereof coupled to a reference potential terminal. The first voltage V1 is a voltage between the base and the emitter of the transistor Q1.

The transistor MP2 has a source thereof coupled to a power supply voltage terminal, and a gate thereof coupled to the bias circuit 900, and a drain thereof coupled to an emitter of the transistor Q2. The transistor Q2 has a base and a collector thereof coupled to a reference potential terminal. The second voltage V2 is a voltage between the base and the emitter of the transistor Q2.

The bias circuit 900 outputs the same voltage to the gates of the transistors MP1 and MP2. The transistors (the PN junction elements) Q1 and Q2 have current densities different from each other. In order to constitute the transistors Q1 and Q2 having different current densities, two methods may be considered. The first method is to make the PN junction areas of the transistors Q1 and Q2 different. The second method is to make the current value flowing from the transistor MP1 being the first current source I1 and the current value flowing from the transistor MP2 being the second current source I2 different. The sizes of the transistors MP1 and MP2 are changed thereby enabling the current values to be flowed to be made different. Either of the two methods is carried out thereby being able to constitute the transistors Q1 and Q2 having current densities different from each other. Accordingly, the second voltage V2 may be made higher than the first voltage V1.

The second to seventh embodiments need the startup circuit 200. However, the startup circuit 200 may be no longer necessary after the reference voltage generating circuit is activated, and has a problem of making circuit operation unstable. Further, when the startup circuit 200 is used, it becomes susceptible to noise such as power supply variation, and there is a problem that it becomes difficult to secure stable operation in a portable device in which a power-off state is likely to occur suddenly.

The embodiment may eliminate the startup circuit 200 by using the bias circuit 900, so that operation may be stabilized. Note that the embodiment is not limited to the second embodiment, and it may also apply to the third to seventh embodiments.

Although the embodiments are numbered with, for example, "first," "second," or "third," the ordinal numbers do not imply priorities of the embodiments. Many other variations and modifications will be apparent to those skilled in the art.

All examples and conditional language recited herein are intended for pedagogical purposes to aid the reader in understanding the invention and the concepts contributed by the inventor to furthering the art, and are to be construed as being without limitation to such ally recited examples and conditions, nor does the organization of such examples in the specification relate to a illustrating of the superiority and inferiority of the invention. Although the embodiment has been described in detail, it should be understood that the various changes, substitutions, and alterations could be made hereto without departing from the spirit and scope of the invention.

According to any of aforementioned embodiments, it may become possible to make a power supply voltage and a reference voltage low voltages that are equal to or less than 1.25 V. A circuit scale may be reduced, and cost reduction and lower power consumption may be achieved.

What is claimed is:

1. A reference voltage generating circuit comprising:

a first PN junction element having a first voltage V1 as a forward voltage;

a second PN junction element having a current density different from the first PN junction element and having a second voltage V2 higher than the first voltage as a forward voltage; and a generating circuit inputting the first voltage V1 and the second voltage V2, and generating a reference voltage expressed by $A2\times V2+A3\times(A2\times V2-A1\times V1)$ in which A1, A2, and A3 are set to be coefficients, and wherein A1 and A2 are different values.

2. The reference voltage generating circuit according to claim 1, wherein the coefficient A1 is larger than the coefficient A2.

3. The reference voltage generating circuit according to claim 1, wherein either of the coefficients A1 or A2 is 1.

4. The reference voltage generating circuit according to claim 1, wherein at least one of the coefficients A1 and A2 is larger than 1.

5. The reference voltage generating circuit according to claim 1, wherein both of the coefficients A1 and A2 are equal to or less than 1.

6. The reference voltage generating circuit according to claim 1, further comprising:

a first differential amplifier circuit having the first voltage V1 generated in the first PN junction element input to a non-inverting input terminal thereof, and its own output terminal coupled to an inverting input terminal thereof via a first resistance and a reference potential terminal coupled to the inverting input terminal thereof via a second resistance; and a second differential amplifier circuit having the second voltage V2 generated in the second PN junction element input to a non-inverting input terminal thereof, and an output voltage from the first differential amplifier circuit input to an inverting input terminal thereof via a third resistance and its own output voltage input to the inverting input terminal thereof via a fourth resistance to output the reference voltage.

7. The reference voltage generating circuit according to claim 1, further comprising:

a first differential amplifier circuit having the first voltage V1 generated in the first PN junction element input to a non-inverting input terminal thereof, and its own output voltage input to an inverting input terminal thereof;

a second differential amplifier circuit having the second voltage V2 generated in the second PN junction element input to a non-inverting input terminal thereof, and its own output voltage input to an inverting input terminal thereof; and a third differential amplifier circuit having an output terminal of the second differential amplifier circuit coupled to a non-inverting input terminal via a first resistance and a reference potential terminal coupled to the non-inverting input terminal thereof via a second resistance, and an output voltage from the first differential amplifier circuit input to an inverting input terminal thereof via a third resistance and its own output voltage input to the inverting input terminal thereof via a fourth resistance to output the reference voltage.

8. The reference voltage generating circuit according to claim 1, further comprising:

a first differential amplifier circuit having the first voltage V1 generated in the first PN junction element input to a non-inverting input terminal thereof, and its own output voltage input to an inverting input terminal thereof;

a second differential amplifier circuit having the second voltage V2 generated in the second PN junction element input to a non-inverting input terminal thereof, and its own output voltage input to an inverting input terminal thereof; and a third differential amplifier circuit having an output terminal of the second differential amplifier circuit coupled to a non-inverting input terminal thereof via a first resistance and a reference potential terminal coupled to the non-inverting input terminal thereof via a second resistance, and an output terminal of the first differential amplifier circuit coupled to an inverting input terminal thereof via a third resistance and a reference potential terminal coupled to the inverting input terminal thereof via a fourth resistance and its own output terminal coupled to the inverting input terminal thereof via a fifth resistance to output the reference voltage.

9. The reference voltage generating circuit according to claim 1, further comprising:

a first differential amplifier circuit having the first voltage V1 generated in the first PN junction element input to a non-inverting input terminal thereof, and its own output voltage input to an inverting input terminal thereof;

a second differential amplifier circuit having the second voltage V2 generated in the second PN junction element input to a non-inverting input terminal thereof, and its own output voltage input to an inverting input terminal thereof;

a third differential amplifier circuit having an output terminal of the first differential amplifier circuit coupled to a non-inverting input terminal via a first resistance and a reference potential terminal coupled to the non-inverting input terminal thereof via a second resistance, and its own output voltage input to an inverting input terminal thereof; and a fourth differential amplifier circuit having an output terminal of the second differential amplifier circuit coupled to a non-inverting input terminal thereof via a third resistance and a reference potential terminal coupled to the non-inverting input terminal thereof via a fourth resistance, and an output voltage from the third differential amplifier circuit input to an inverting input terminal thereof via a fifth resistance and its own output voltage input to the inverting input terminal thereof via a sixth resistance to output the reference voltage.

10. The reference voltage generating circuit according to claim 1, further comprising:

a first differential amplifier circuit having the first voltage V1 generated in the first PN junction element input to a non-inverting input terminal thereof, and its own output terminal coupled to an inverting input terminal thereof via a first resistance and a reference potential terminal coupled to the inverting input terminal thereof via a second resistance;

a second differential amplifier circuit having the second voltage V2 generated in the second PN junction element input to a non-inverting input terminal thereof, and its own output terminal coupled to an inverting input terminal thereof via a third resistance and a reference potential terminal coupled to the inverting input terminal thereof via a fourth resistance; and a third differential amplifier circuit having an output voltage from the second differential amplifier circuit input to a non-inverting input terminal thereof, and an output voltage from the first differential amplifier circuit input to an inverting input terminal thereof via a fifth resistance and its own output voltage input to the inverting input terminal thereof via a sixth resistance to output the reference voltage.

11. The reference voltage generating circuit according to claim 1, further comprising:

a first differential amplifier circuit having the first voltage V1 generated in the first PN junction element input to a non-inverting input terminal thereof, and its own output terminal coupled to an inverting input terminal thereof via a first resistance and a reference potential terminal coupled to the inverting input terminal thereof via a second resistance;

a second differential amplifier circuit having the second voltage V2 generated in the second PN junction element input to a non-inverting input terminal thereof, and its own output voltage input to an inverting input terminal thereof; and a third differential amplifier circuit having an output terminal of the second differential amplifier circuit coupled to a non-inverting input terminal thereof via a third resistance and a reference potential terminal coupled to the non-inverting input terminal thereof via a fourth resistance, and an output voltage from the first differential amplifier circuit input to an inverting input terminal thereof via a fifth resistance and its own output voltage input to the inverting input terminal thereof via a sixth resistance to output the reference voltage.

12. The reference voltage generating circuit according to claim 1, wherein the first and second PN junction elements are transistors.

13. The reference voltage generating circuit according to claim 1, further comprising:

a first current source to allow a current to flow to the first PN junction element; and a second current source to allow a current to flow to the second PN junction element.

14. The reference voltage generating circuit according to claim 13, wherein the first and second current sources are constituted by first and second field effect transistors respectively.

15. The reference voltage generating circuit according to claim 14, further comprising;

a first differential amplifier circuit having a non-inverting input terminal thereof coupled between the first field effect transistor and the first PN junction element, and an inverting input terminal thereof coupled between the second field effect transistor and the second PN junction element, and an output terminal thereof coupled to gates of the first and second field effect transistors.

16. The reference voltage generating circuit according to claim 13, further comprising:

a first resistance coupled between the first current source and the first PN junction element.

17. The reference voltage generating circuit according to claim 15, comprising:

a startup circuit to control voltages of an input terminal and an output terminal of the first differential amplifier circuit.

18. The reference voltage generating circuit according to claim 14, further comprising:

a bias circuit outputting the same voltage to gates of the first and second field effect transistors.

19. The reference voltage generating circuit according to claim 1, wherein the first and second PN junction elements are first and second bipolar transistors respectively.

20. The reference voltage generating circuit according to claim 19, wherein bases of the first and second bipolar transistors are coupled to a reference potential terminal.

* * * * *